United States Patent [19]

Perkins

[11] 4,163,131

[45] Jul. 31, 1979

[54] DUAL-COMPRESSION GAS-BLAST PUFFER-TYPE INTERRUPTING DEVICE

[75] Inventor: John F. Perkins, Monroeville, Pa.

[73] Assignee: Westinghouse Electric Corp., Pittsburgh, Pa.

[21] Appl. No.: 823,820

[22] Filed: Aug. 11, 1977

[51] Int. Cl.[2] ..... H01N 33/88

[52] U.S. Cl. ..... 200/148 A; 200/150 G

[58] Field of Search ..... 200/148 A, 148 R, 150 G

[56] References Cited

U.S. PATENT DOCUMENTS

| | | | |
|---|---|---|---|
| 3,331,935 | 7/1967 | Milianowicz | 200/148 A |
| 3,786,215 | 1/1974 | Mauthe | 200/148 A |
| 3,991,292 | 11/1976 | Perkins | 200/148 A |

*Primary Examiner*—Robert S. Macon

*Attorney, Agent, or Firm*—W. A. Elchik

[57] ABSTRACT

A fluid-blast circuit-interrupter of the puffer-type is provided having two connected piston structures, one designated herein as a primary piston structure, and the other termed a secondary piston structure, connected serially mechanically in tandem series arrangement to thereby compress a suitable arc-extinguishing fluid in two separate compression chambers. Valve action is utilized to delay the initiation of the second gas-blast from the second compression chamber toward the arc until the separable interrupting contacts have reached a desired predetermined contact separation distance. By suitably changing the component dimensions of the interrupter, the degree of gas compression, and the instant of gas-blast application of the second arc-extinguishing blast, may be changed without delaying the instant of initial contact separation.

14 Claims, 7 Drawing Figures

SULFUR-HEXAFLUORIDE ($SF_6$) GAS, FOR EXAMPLE

FIG. 2
CLOSED POSITION
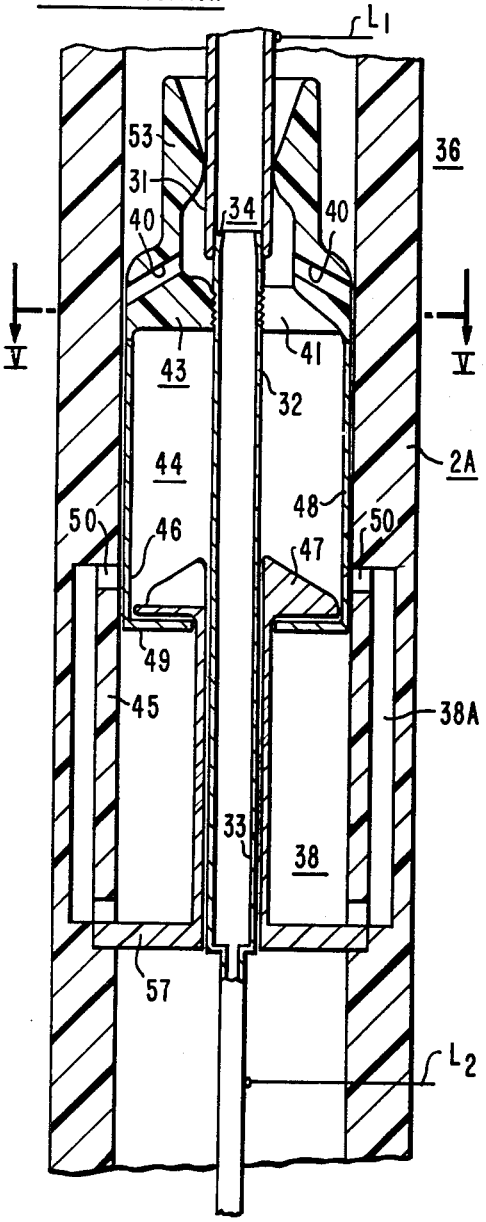
FIG. 4
FULLY OPEN POSITION
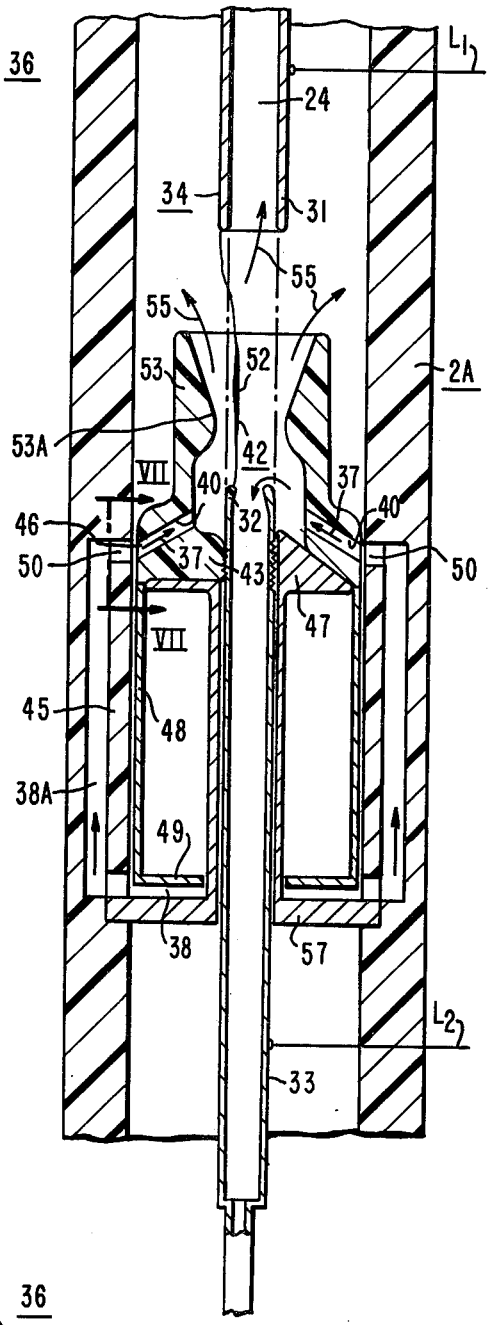
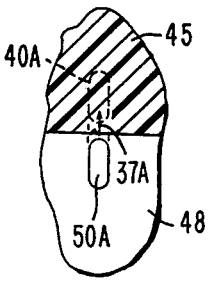
FIG. 7
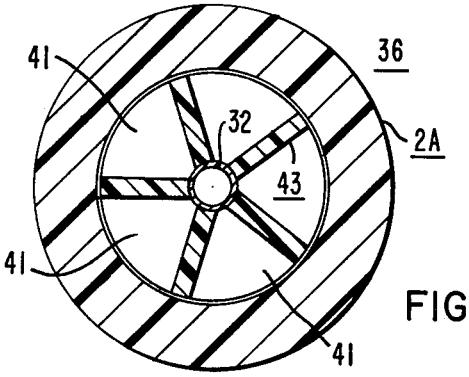
FIG. 5

DUAL-COMPRESSION GAS-BLAST PUFFER-TYPE INTERRUPTING DEVICE

BACKGROUND OF THE INVENTION

1. Field of the Invention

This invention relates in general to circuit-interrupters and more particularly to fluid-blast circuit-interrupters of the puffer-type.

2. Description of the Prior Art

The advantages of using sulfur-hexafluoride ($SF_6$) gas in fluid-blast circuit-interrupters are well known to those skilled in the art. There are two basic types of fluid-blast circuit-interrupters using $SF_6$ gas: two-pressure interrupters and puffer-type interrupters. The two-pressure interrupters uses a gas compressor to produce a reservoir of high-pressure gas, which creates a blast of gas to extinguish the arc established between separating contacts. Since the gas storage reservoir may be large, and the gas pressure inside it high, this type of breaker is suitable for higher interruption ratings. The puffer interrupter, on the other hand, maintains a relatively-low ambient gas pressure inside the interrupter, typically about 60 p.s.i., for example, and produces a gas blast for the purpose of arc extinction by means of a transient compression of gas performed by a movable piston member. The puffer is normally used for lower interruption ratings only. The prime advantage of a puffer interrupter is its lower cost, for it does not require heaters to prevent gas liquification of the gas or expensive compressor components, which are necessary in a two-pressure circuit-breaker. Therefore, it would be desirable to use a puffer-type interrupter in service categories requiring a higher interruption rating.

The size and cost of a circuit-interrupter actuating mechanism can be minimized when interrupting capability is limited to the service rating, plus a sufficient safety margin. One method for varying the interruption capability requiring few component modifications is to vary the degree of compression to which the arc-extinguishing fluid is subjected prior to initiation of the arc-extinguishing blast. However, varying the degree of gas compression in previous circuit-interrupters has often required a delay in the separation of contacts resulting in a delay in arc establishment. It would be desirable to produce a circuit-breaker design suitable for a variety of ratings by varying the degree of gas compression without delaying the moment of arc initiation.

In U.S. Pat. No. 3,331,935, entitled "Gas-Blast Circuit-Breaker Having Dual Piston Means Providing Double-Acting Puffer Arrangement," issued July 18, 1967 to Stanislaw A. Milianowicz, and assigned to the assignee of the instant application, there is disclosed a gas-type circuit-interrupter using two pistons to compress arc-extinguishing fluid within the same volume, thereby producing two blasts of fluid. It would be desirable to produce a circuit-interrupter generating two blasts of arc-extinguishing fluid with a simpler mechanism.

SUMMARY OF THE INVENTION

In accordance with a preferred embodiment of the present invention there is provided a fluid-blast circuit-interrupter of the puffer type, which includes primary and secondary gas compression means, and primary and secondary movable pistons cooperable with the compression means to produce two blasts of arc-extinguishing fluid. The degree of fluid compression can be varied without delaying the time of contact separation, allowing a single design to be used in interrupters having a variety of service ratings.

BRIEF DESCRIPTION OF THE DRAWINGS

The invention may be readily understood when considered in view of the following detailed description of exemplary embodiments thereof, taken with the accompanying drawings in which:

FIG. 2 is a vertical sectional view taken through the improved dual-compression, puffer-type double-piston interrupting device of the instant application, with the separable contact structure being illustrated in the closed-circuit position;

FIG. 4 is a view somewhat similar to that of FIGS. 2 and 3, except illustrating a later point in the opening operation, when the full benefit of the secondary blast of gas occurs out of the secondary compression chamber;

FIG. 5 is a sectional plan view taken substantially along the line V—V of FIG. 2;

FIG. 7 is a fragmented sectional view of an alternative blast orifice and inlet aperture configuration, taken along the line VII—VII of FIG. 4.

DESCRIPTION OF THE PREFERRED EMBODIMENTS

Figure 1:
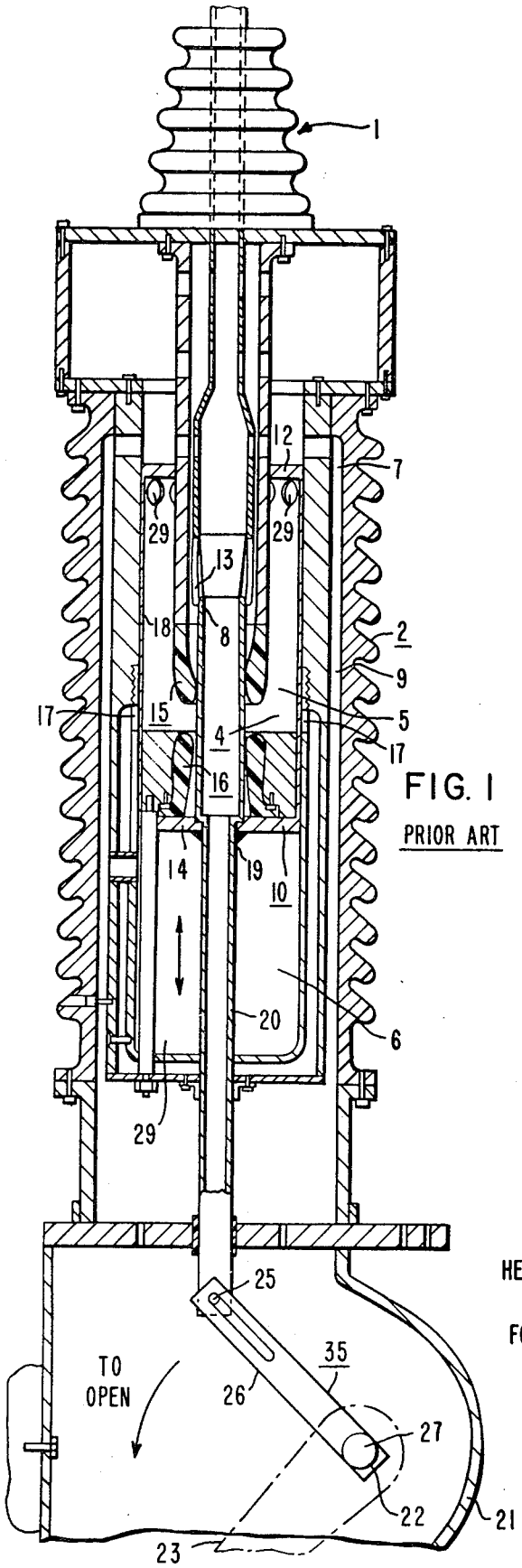
FIG. 1 PRIOR ART
FIG. 1 is a vertical sectional view taken through a prior-art type of interrupting device utilizing two pistons mechanically connected in tandem-series arrangement with the separable contact structure being illustrated in the closed-circuit position.

Referring to the drawings, and more particularly to FIG. 1 thereof, the reference numeral 1 generally designates a prior-art type of dual-acting puffer-type interrupting structure, as more clearly set forth in U.S. Pat. No. 3,991,292, issued Nov. 9, 1976 to John F. Perkins, and assigned to the assignee of the instant patent application.

As set forth more clearly in FIG. 1, there is provided a casing structure 2 formed of a suitable weather-resistant material, such as porcelain, for example. Disposed interiorly within the outer porcelain weather-casing 2 is a composite, compression chamber 4, including a first, or primary compression chamber 5, and a second, or secondary compression chamber 6. Acting to compress gas 7, such as sulfur-hexafluoride ($SF_6$) gas, for example, within the said two primary and secondary compression chambers 5,6 is a composite, dual-acting piston structure 10 comprising two movable piston members, namely an upper first primary movable piston member 12, and a lower secondary movable piston member 14, the two being mechanically interconnected by a movable piston-sleeve interconnecting member 18, fixedly secured, as by welding, for example, at 19 to a tubular reciprocally-operable contact-operating member 20. The lower end of the vertically-movable tubular contact-operating member 20 is affixed, as by a pivotal connection 25, to an internally-disposed crank-arm 26 affixed to a contact-operating shaft 27. The internal crank-arm 26 is actuated externally of a mechanism casing 21 by an externally-extending operating shaft 27 passing through a suitable gas-seal located at 22.

Accordingly, it will be observed that counter-clockwise rotation of the externally-located crank-arm 23, effects rotation of the operating shaft 23, resulting in downward opening movement of the movable contact-operating rod 20. Such opening action establishes an arc (not shown) between a stationary tubular contact 13 and a cooperable movable tubular contact member 8. Gas compression ensues, first at the primary, or first gas-compression chamber 5, and at a later point of time, following a time lag, at which the inlet apertures 29 become in alignment with blast-orifices (not shown). Reference may be had to the aforesaid U.S. Pat. No. 3,991,292, with particular reference to FIG. 3 thereof, to indicate the time of secondary injection of the gas-blast from the secondary compression chamber 6.

The present invention is particularly concerned with an important improvement of the dual-acting piston construction of the prior-art type of device 1, illustrated in FIG. 1, by avoiding the use of a shunting piston-sleeve, such as the member 18 of FIG. 1.

With reference to FIGS. 3—6, it will be observed that there is provided an upper-disposed, stationary, tubular contact member 31 separably engaging with a movable contact member 32, the latter being actuated in a vertical, reciprocal manner in its opening and closing movements by a lower contact-operating rod 33. The actuation of the separable contact structure 34 is effected by any suitable operating mechanism, such as a linkage 25, 26, 27, as illustrated in FIG. 1, or, alternatively, as by a hydraulic, solenoid, or pneumatic mechanism (not shown).

The closed-circuit position of the device 36 is illustrated in FIG. 2, wherein the separable contacts 31, 32 are in contacting engagement, thereby permitting the transmission-line current $L_1$, $L_2$ to pass through the circuit-interrupting device 36.

Figure 3:
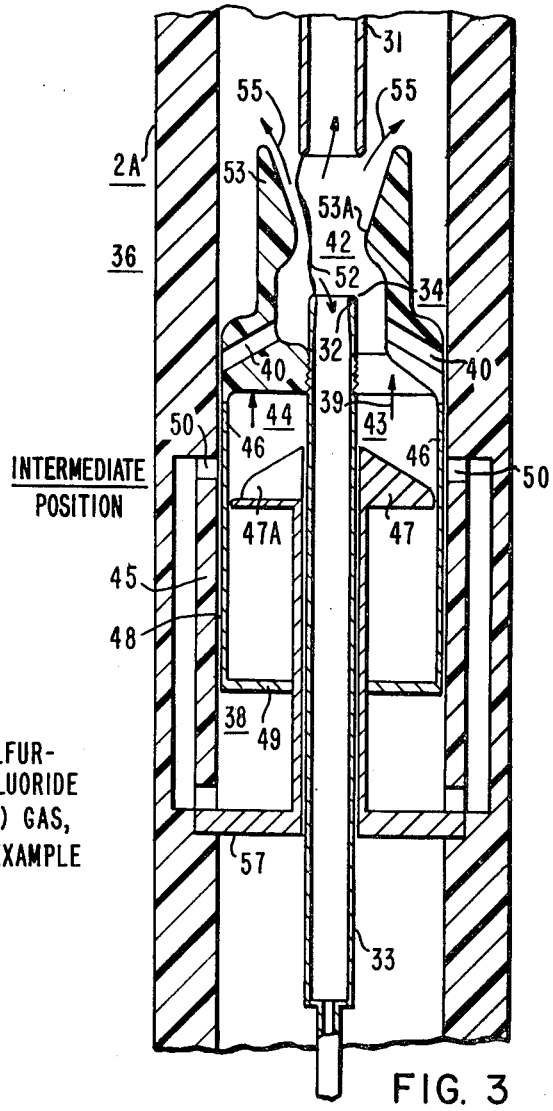
FIG. 3 is a fragmentary view, somewhat similar to that of FIG. 2, but illustrating the position of the component contact parts at an intermediate point in the opening operation of the interupter, following the establishment of arcing between the separable contacts.

FIG. 3 illustrates an intermediate opening position; and FIG. 4 illustrates a later stage in the opening operation, wherein the blast 37 from the secondary compression chamber 38 is permitted to flow through the inlet apertures 51, 50 and 40 into the arcing region 42.

It will be observed that during the initial portion of the opening operation, a compression of gas occurs within the first, or primary compression chamber 44 causing an immediate upward flow of the compressed gas into the arc region 42, as illustrated in FIG. 3, whereas due to valve action, there is no secondary gas flow, until the piston sleeve 48 moves downwardly far enough, as illustrated in FIG. 4, to permit alignment of the blast apertures 50 with the inlet apertures 40, thereby providing a desirable secondary gas flow 37 into the arcing region 42 and through the movable nozzle member 53.

It will be obvious that the timing of the secondary blast 37 may be readily achieved by a proper location of the position of the blast orifices 50 and their configuration. For example, instead of having round blast-orifices 50 in alignment, with round inlet apertures 40, instead an elongated inlet aperture 40A and an elongated blast aperture 50A could readily be provided, as shown in FIG. 7, to prolong the length of time of secondary gas flow 37A into the arcing region 42.

Also, the dimensions of the casing structure 2A may be considerably reduced, as opposed to the prior-art tandem piston construction 1 of FIG. 1, by the particular construction shown, inasmuch as the outer annular interconnecting chamber 9 of FIG. 1 may be eliminated.

It will be observed that in the novel circuit-interrupting structure 36 of the instant invention, the nozzle structure 53 is movable, whereas in the prior-art structure 1 of FIG. 1, the pair of nozzle structures 15 and 16 were in fixed stationary spaced arrangement with respect to each other.

Accordingly, in the improved interrupting structure 36 of the instant invention, there is an immediate application of gas flow 39 from the first, or primary compression chamber 44 as a result of the inlet apertures 41 of the spider structure 43, with the gas flow 39 flowing through the tubular stationary contact 31 and also axially downwardly through the tubular movable contact member 32. It will be obvious that following withdrawal of the movable nozzle structure 53 away from the stationary tubular contact 31, an additional flow 55 will be created around the stationary contact 31, as indicated by the arrows 55 of FIG. 3 and 4. Finally, the seondary blast-flow 37 will occur at a proper desired time later in the opening stroke, when the alignment of the blast-aperture 50 with the inlet apertures 40 occurs, as illustrated more clearly in FIG. 4 of the drawings.

Figure 6:
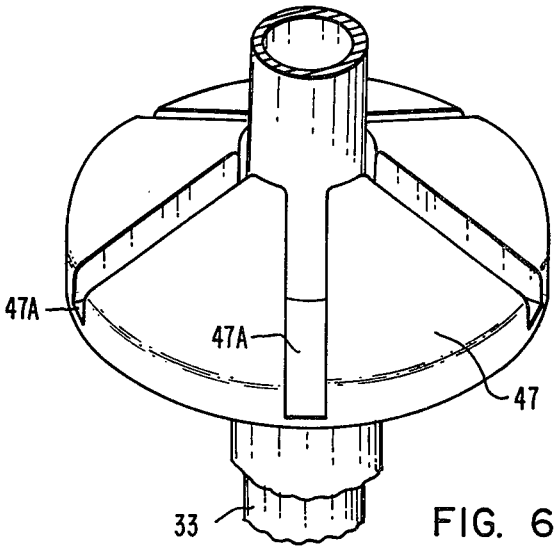
FIG. 6 is a perspective view illustrating in more clarity the stationary piston structure associated with the first compression chamber.

FIG. 6 illustrates fragmentarily, and in perspective, the configuration of the stationary piston structure 47 having angularly-located slots 47A formed therein to accommodate the spider structure 43 associated with the movable nozzle structure 53 of the circuit-interrupter 36. It will be noted that the slots 47A of the stationary piston structure 47 do not extend completely through the piston 47, as this would prevent compression of gas within the first compression chamber 44.

Since the ambient pressure wthin a puffer interrupter is relatively low (typically 60 p.s.i. to 75 p.s.i.), the high pressure required to produce the gas-blast necessary to cool and extinguish the circuit-breaking arc is achieved by using a piston to compress the gas some milliseconds before the interruption is to occur. Most puffers use only one piston for this compression. Some arrangements use two pistons, which, however, act on only one compression volume as in U.S. Pat. No. 3,331,935. U.S. patent application Ser. No. 513,913 filed Oct. 10, 1974 by the applicant herein, now U.S. Pat. No. 3,991,292 described a new concept for a puffer interrupter (FIG. 1) using two pistons ganged together on one actuating rod 20 so that each piston 12, 14 compresses gas in a separate compression volume; here, moving pistons compressed the gas, which then flowed through a stationary nozzle assembly 15,16 (FIG. 1). The present invention extends the concept of the device 1 of FIG. 1 to puffer configurations in which compression is achieved by moving the main interrupting nozzle 53 towards a stationary piston 47.

One embodiment of the present invention is shown in FIG. 2. In the closed position, stationary contact nozzle 31 is in contact with moving nozzle contact 32. The moving contact 32, nozzle 53, piston-sleeve 48, upper spider assembly 43, lower moving piston 49 and actuating rod 33 all move together as one unitary assembly. When this assembly begins its downward movement, the gas in volume 44 is compressed by the upper stationary piston 47; similarly, the lower moving piston 49 compresses the gas in the volumes 38 and 38A. The lower stationary partition member 57 is the lower boundary of the volume 38, and volume 38 is joined to the annular volume 38A by a ring of orifices 5;.

An arc 52 is drawn between the contacts 31 and 32 some time after the beginning of the stroke, this time depending upon the degree of overlap between these separable contacts 31, 32. The onset of arcing 52 can be substantially delayed compared to its onset in FIG. 4 in two ways: (1) by increasing the distance from the upper extremity of contact nozzle 32 and the throat 53A of nozzle 53; and (2) by lengthening the distance from the throat 53A of nozzle 53 to the orifices 51, so that the stationary contact 31 can be extended down into the moving nozzle assembly 53. These means are also ways of delaying the initiation of flow from the volume 44 onto the arc 52. There are many ways of delaying arcing and initiating the flow from volume 44 achievable by changing the relative dimensions of stationary contact 31, moving contact 32, and the assembly comprising nozzle 53 and the movable spider 43.

In the embodiment shown in FIGS. 3–5, the gas compressed in volumes 38 and 38A only begins to blast the arc 52 at the end of the opening stroke, when the orifices 51 in the movable nozzle 53 and movable spider assembly 43 align with orifices 50 in the interrupter wall 45. However, this flow can be initiated at any earlier time during the opening stroke simply by elongating these orifices 50, 51 in the direction parallel to the interrupter axis 24, as shown in FIG. 7.

In comparison with the prior-art puffers, the present invention virtually doubles the volume of compressed gas 7 available for blasting the arc simply by the addition of the second piston 49. This is accomplished without increasing stroke length and without lengthening the interrupt body (except for the thickness of the second piston 49 and the stationary partition member 57). A slight increase in the diameter of the interrupter 36 is necessary to accommodate the annular flow volume 38A necessary to channel flow from the second source 38 into the arcing region 42 by way of orifices 51, 50 and 40.

No attempt has been made to optimize the position of the flow inlet orifices 51, and these may be arranged in any of several suitable ways, e.g. (i) position orifices 51 nearer to the throat of movable nozzle 53; (ii) adjust the angle of these inlet channels 51 with respect to the axis 24 of the interrupter to direct more flow downwards through moving nozzle 53.

In a more sophisticated embodiment, the principle of the present structure can be extended from a two-piston device to a multiple-piston device with all pistons mechanically connected in tandem-series arrangement. This can be achieved simply by supporting additional stationary pistons 47 in the same manner as illustrated in FIG. 3, extending piston sleeve 48, and adding additional moving pistons 49.

Although there has been illustrated and described specific structures, it is to be clearly understood that the same were merely for the purpose of illustration, and that changes and modifications may readily be made therein by those skilled in the art, without departing from the spirit and scope of the invention.

I claim:

1. A dual-piston-acting gas-blast puffer-type circuit-interrupter comprising, in combination:

(a) means defining primary and secondary compression chambers, (b) means for supplying arc extinguishing fluid to said primary and secondary compression chambers;

(c) means defining primary and secondary movable pistons movable within said primary and secondary compression chambers;

(d) means for moving said pistons;

(e) movable nozzle means movable with said primary and secondary movable pistons defining an arcing chamber;

(f) a pair of separable arcing contacts separable to initiate an arc therebetween within said arcing chamber; and, (g) valve means operable by the movement of said movable primary and secondary pistons to initiate separate flows of arc-extinguishing fluid from said primary and said secondary compression chambers into said arcing chamber.

2. A dual-piston-acting gas-blast puffer-type circuit-interrupter as described in claim 1, wherein said movable primary and secondary pistons are connected in tandem in a unitary structure.

3. A dual-piston-acting gas-blast puffer-type circuit-interrupter as claimed in claim 2, wherein said valve means comprises one or more blast vents communicating between said secondary compression chamber and said arcing chamber, and a movable piston-sleeve mechanically interconnecting said primary and said secondary pistons and having one or more inlet apertures, said movable piston-sleeve obstructing said blast vents when said interrupter is in the closed-circuit position, actuation of said piston moving means aligning said inlet apertures with said blast vents to initiate a secondary blast of arc extinguishing fluid into the arcing chamber.

4. The puffer-type interrupter, as described in claim 3, wherein the location of said inlet apertures through said piston-sleeve determines the instant of blast initiation relative to the instant of contact separation, and the axial length of said inlet apertures determines the duration of the gas blast.

5. A puffer-type circuit interrupter, as claimed in claim 1, wherein at least one of said fluid flows occurs when said contacts are fully separated.

6. The combination according to claim 1, wherein a stationary piston structure provides a partition member interposed between the primary and secondary compression chambers.

7. A puffer-type circuit-interrupter, as claimed in claim 1, wherein said valve means produces a delayed initiation of at least one of said fluid flows relative to the establishment of said arc.

8. A puffer-type circuit-interrupter comprising, in combination, (a) means defining a housing containing an arc-extinguishing fluid, (b) means defining separate primary and secondary compression chambers disposed within said housing;

(c) a movable primary piston operable to compress arc-extinguishing fluid within said primary compression chamber;

(d) means defining a secondary compression chamber disposed within said housing;

(e) means defining a movable secondary piston operable to compress arc-extinguishing fluid within said secondary compression chamber;

(f) movable nozzle means defining an arcing chamber;

(g) means defining a relatively-fixed contact;

(h) means defining a movable contact structure comprising an arcing contact; and (i) means mechanically interconnecting said movable primary and secondary pistons, said movable contact structure being cooperable with said relatively-fixed contact structure to establish an arc therebetween and at the same time driving said two pistons to compress arc-extinguishing fluid within said primary and secondary compression chambers; and, (j) valve means actuated by said movable contact structure operable to initiate fluid flow from said primary and secondary compression chambers into said arcing chamber.

9. The combination according to claim 8, wherein at least one of said separable contacts being of tubular construction to provide a venting flow therethrough.

10. The combination according to claim 8, wherein means defining a stationary piston constitues the partition means separating the primary and secondary compression chambers.

11. The combination according to claim 8, wherein passage means is provided within said housing interconnecting with said secondary compression chamber and additionally providing a plurality of radially-inwardly-directed stationary blast apertures, and said movable nozzle means provides a plurality of radially-inwardly-directed inlet apertures which at a predetermined time align with said first-mentioned blast apertures.

12. The combination according to claim 8, wherein both of said separable contacts are tubular and provide venting flow therethrough.

13. The combination according to claim 1, wherein the movable piston means comprises a movable piston-sleeve having attached thereto adjacent one end thereof the movable nozzle means, and the other end of said movable piston-sleeve comprises an inwardly-directly flange portion, and said inwardly-directed flange portion abuts the lower end of the stationary piston structure in the closed-circuit position of the circuit-interrupter.

14. The combination according to claim 1, wherein means provides a reverse gas-flow from the secondary compression chamber for additional cooling of the gas flow emanating from said secondary compression chamber.

* * * * *